US005332221A

United States Patent [19]

Reed

[11] Patent Number: 5,332,221

[45] Date of Patent: Jul. 26, 1994

[54] MULTI-CHANNEL GAME PUZZLE WITH MOVABLE BASE

[76] Inventor: Brian Reed, 8 Carlos Dr., Berkley, Mass. 02779

[21] Appl. No.: 81,497

[22] Filed: Jun. 22, 1993

Related U.S. Application Data

[63] Continuation-in-part of Ser. No. 667,032, Mar. 7, 1991, Pat. No. 5,221,085, and a continuation of Ser. No. 901,371, Jul. 28, 1992, Pat. No. 5,251,899.

[30] Foreign Application Priority Data

Mar. 6, 1992 [EP] European Pat. Off. ..... PCT/US92/01783

[51] Int. Cl.[5] ..... A63F 9/12

[52] U.S. Cl. ..... 273/153 S; 273/109

[58] Field of Search ..... 273/153 R, 153 S, 155, 273/109, 110, 113

[56] References Cited

U.S. PATENT DOCUMENTS

| | | | |
|---|---|---|---|
| 743,605 | 11/1903 | Wilson | 273/153 R |
| 4,957,291 | 9/1990 | Miffitt et al. | 273/153 R |

FOREIGN PATENT DOCUMENTS

| | | | |
|---|---|---|---|
| 1263266 | 10/1986 | U.S.S.R. | 273/153 S |
| 1296193 | 3/1987 | U.S.S.R. | 273/153 S |
| 1514391 | 10/1989 | U.S.S.R. | 273/153 S |
| 2086240 | 5/1982 | United Kingdom | 273/153 S |

*Primary Examiner*—Vincent Millin
*Assistant Examiner*—William M. Pierce
*Attorney, Agent, or Firm*—Thomas A. Kahrl

[57] ABSTRACT

A multi-channel game puzzle with movable base utilizing manual tilting employing the multi-channel game puzzle, the game puzzle including a housing defining a main chamber and having a vertical axis further including a plurality of channels positioned in a common plane within the main chamber being equally spaced and extending radially outward, a central hub having a socket cooperating with a movable shaft for rotably mounting the central hub within the main chamber about the common vertical axis movement reciprocally between an upper locked position for locking the playing pieces in the channels and a lower free swivel position for permitting free swiveling of the inner chamber relative to the housing upon manual tilting of the housing between a first communication position, a second communication position, a third communication position and a fourth communication position and including a plurality of sets of game pieces each set having like marked game pieces also including a unitary blocker piece having distinctive marking characteristics wherein play is commenced by a player grasping the outer surface of the housing, releasing the hub to the free swivel position and tilting to urge the game pieces from one channel from one channel to another and to rotate the central hub relative to the housing for accepting and discharging player pieces for rearrangement of the sequence.

14 Claims, 4 Drawing Sheets

MULTI-CHANNEL GAME PUZZLE WITH MOVABLE BASE

REFERENCE TO PRIOR APPLICATIONS

This application is a continuation in part of U.S. patent application Ser. No. 07/667,032 filed Mar. 07, 1991, now U.S. Pat. No. 5,221,085, and of U.S. patent application Ser. No. 07/901,371 filed Jul. 28, 1992, now U.S. Pat. No. 5,251,899, as a divisional application of Ser. No. 07/667,032, which are incorporated herein by reference.

BACKGROUND OF THE INVENTION

In the past, mechanically operated, hand-held puzzles have been found to be popular in that such puzzles seek to challenge a player's ability to solve problems while exercising memory recall and at the same time testing his or her physical dexterity.

Certain games and puzzles are known in the art including puzzles in which the playing pieces are connected in a manner permitting only prescribed motions relative to each other, such pieces being initially randomly scrambled, with the object being to unscramble the game pieces. In the unscrambled orientation, the pieces are placed in a recognized series or order. By changing the orientation of the pieces, they become scrambled and the object of the game involved is an unscrambling operation requiring movement of the game pieces relative to one another, the sequence and types of movements varying in character and difficulty. One such game puzzle is the so-called RUBICS CUBE device as is shown in U.S. Pat. No. 3,655,201 (Nichols). In that puzzle the object is to rearrange the colors of the faces of the game pieces by rotation of groups of nine pieces at a time. All of such nine pieces occupying a given row or column of the cube.

It is desirable to provide for a new and improved multichannel game puzzle which involves manual dexterity, memory recall and problem solving capabilities of a player when rearranging the positions of a series of mobile player pieces contained within multiple channels forming passageways interconnected by a central hub wherein, the player causes rearrangement of the player pieces by manually tilting the game device such that the game pieces are urged from one channel to another via the central hub to achieve the specified arrangement as a goal.

SUMMARY OF THE INVENTION

The invention relates to a game puzzle apparatus including a plurality of sets of game pieces which utilizes tilting by a player to realign the player pieces in a preselected order. In particular, the invention concerns a multi-channel game puzzle wherein multiple player pieces are positioned in a scrambled order in multiple channels contained within a hollow housing constructed of transparent material connected by a centrally positioned, swivel-mounted hub having two chambers forming an internal passageway, the player pieces being moved responsive to hand-held tilting and rotation in an effort to realign the player pieces in a preselected unscrambled order, and the hub is manually reciprocally movable, upwardly and downwardly between a locked position and a free swiveling position.

In the preferred embodiment the game puzzle apparatus contains a housing constructed of a clear spherical shaped housing and includes a series of five channels of hollow tubular construction, also of transparent material equally spaced about the center of the spherical housing extending radially outward in a common plane from a centrally located central hub, pivotably mounted on the vertical axis of the housing with each channel constructed to contain a plurality of, preferably five in number, player pieces. The player pieces consist of multiple sets, preferably five in number of differently marked playing pieces, preferably playing balls, with each set having four like marked pieces. The spherical housing also contains a flat segment surface having a central aperture adapted to accommodate a base apparatus to facilitate placing the game puzzle on a flat surface to provide a pause in the tilting of the puzzle solving process and for storing the device in between play, as well as for moving the hub upwardly and downwardly between an upper locking position wherein the player pieces are locked in the channels and the hub is locked, and a lower free swiveling position wherein the hub is free to swivel for exchanging game pieces.

In the preferred embodiment the housing consists of a spherical shell having a flat bottom surface characterized by an annular opening located coaxial with the central axis. The game puzzle further includes a plurality of hollow channels positioned in a common plane, perpendicular to the central axis, equally spaced and extending radially outward from the hub, each channel having an inner open end and an outer open end, the outer end connected to the shell. The hub is positioned on the central axis of the housing for selectively connecting adjacent hollow channels for transferring game pieces consisting of a dome having an opaque exterior surface defining a plurality of cavities forming a movable passageway between the said channels. Included at the bottom of the hub is a cylindrical movable base for supporting the housing comprising a column element having a central bore, a flat base member for supporting the game puzzle on a flat surface, and a groove member with shoulder configured to associate with a bottom aperture of the housing for permitting reciprocal movement along the vertical axis of the housing relative to the base member. The column element extending from the base member of the housing upwardly to the midpoint of the housing for supporting a hub with a central bore constructed to receive the shaft for permitting freedom of rotation of the hub relative to the housing about a common generally vertical, central axis. The base is constructed with a cylindrical column having collar for receiving the bottom half hemispherical member having a defined circumference adapted to extend through the annular opening, comprising a through hole, into the chamber permitting the housing to move between lower free swiveling position for permitting free swiveling in both directions upon manual tilting of the housing and an upper locked position. The force of gravity is such as to normally urge the hub in the lower swiveling position and application of to upward pressure exerted manually against the base releases any playing pieces obstructed between the hub means and the channel means.

Furthermore, an additional single blocker piece, preferably a ball, having marking characteristics distinct from those found on playing balls, is present to add to the difficulty of the puzzle and solution. The object of the solution is to combine all like marked balls into a preselected channel, preferably a total of four balls in each channel, the channels being constructed as to be slightly larger in diameter than the playing balls and designed to accept any combination of up to five balls at any one time. The channels are affixed to the clear spherical housing and at the outer end and each contain at the outermost point an annular opening adapted to receive removable plugs for the express purpose of providing access for removing the balls in order to reset the puzzle by inserting and mixing the player balls prior to commencing play.

The central hub is mounted at the axis at the very core of the clear spherical housing, the sphere being a non-clear solid colored chamber containing two cavities large enough to accept any one of the playing balls and/or blocker ball and obscuring them from the player's view. The radial location of the cavities relative to one another is the radial distance between the channels.

Method of Play

The game puzzle consists of an outer clear spherical housing in which internally affixed about the center is a group of five equally spaced radially extending channels. Restrained within the channels are five sets of differently marked playing balls with each set having four like marked balls. For the purpose of explanation it is assumed that these playing balls are differentiated by color and therefore exists a set of five playing balls with the following characteristics: four red playing balls, four green playing plays, four yellow playing balls, four blue playing balls and four purple playing balls.

In addition to the above there is present one blocker ball which for the purpose of explanation is colored black.

Finally, the puzzle is completed by the presence of a central hub internally mounted in such a way as to allow rotation freedom about a fixed axis in both directions. Also provided within this inner sphere is two cavities located opposite in spaced apart relationship to one another and in horizontal alignment with the five equally spaced channels containing the colored playing balls. These two cavities are large enough to accept the presence of any one of the player balls or blocker ball.

Play begins when the five equally spaced channels are filled with different colored balls, with the hub in the upper locked position. The object of the puzzle is to relocate the colored balls in such a way that each equally spaced channel contains only those balls of the same color. This is accomplished by releasing the base from upward pressure permitting the hub to fall downwardly permitting it to freely swivel aligning the channels with the cavities of the hub to release the game pieces from the channels and tilting the puzzle and allowing a player ball or blocker ball to evacuate a particular channel and enter one of the cavities provided within the central hub.

Because the balls are weighted, this imbalance to concentricity will cause the central hub to rotate. The player must then align the cavity which carries the ball in play in proximity to the channel in which he or she wishes the ball to reside. By tilting the central hub toward the intended channel the ball in play will exit the central hub and reposition itself inside the preselected channel. In addition, and occurring concurrent with this event, the cavity opposite and opposing the cavity carrying the ball in play will begin to accept the new ball. The player must take notice of what color ball is entering the cavity since once seated in the cavity of the central hub, it will no longer be visible to the player. This process is repeated until such time that all the like colored balls are residing in a common separate channel to be stored. At any time during the game, play can be paused by simply placing the puzzle on its flat area, provided on the, housing, on any flat surface such as a desk or table. To reset the puzzle one must remove the retaining plugs provided in each channel and evacuate the balls. The player balls can then be scrambled according to color and reinstalled into the five channels placing four differently colored balls in each channel. Replacing the retaining plugs into the five channels complete the puzzle reset process and the game is now ready for play. Although the aforementioned preferred embodiment refers to a spherical outer housing fitted with a flat surface area for stability of storage, the device's outer skin could be provided in a cubic or pyramid shaped configuration. The internal components would only have to be altered to accommodate the new outer geometry but could otherwise remain functionally the same.

In an alternate embodiment of the invention a multichanneled game puzzle is provided with a plunger positioned centrally in a housing provided with a spherical shell having a central axis configured to define a main chamber. The housing consists of a shell element having a top hemispherical member and a bottom hemispherical member wherein the top hemispherical member includes a central tube positioned on the central axis enclosing the plunger mounted in the tube having a coiled spring adapted for urging the game puzzle with plunger downwardly in the tube. The shell is positioned on the bottom hemispherical element, is configured with a flat bottom surface, and is characterized by an annular opening adapted to receive a base member having a rapid permitting movement of the shell on the base between a down position and an up position. A plurality of channels are provided for containing one or more game pieces. Each channel is constructed as a hollow tubular channel with each being in a common plane perpendicular to the central axis. Said channels extend radially outward from the central hub positioned centrally in the main chamber adapted for selectively connecting adjacent hollow channels for transferring game pieces. The hub is constructed of a dome element having an opaque exterior surface for concealing the playing pieces that can occupy one of a plurality of cavities provided in the hub. The hub forms a movable passageway for connecting adjacent channels for moving game pieces from a first channel to a second channel- Said hub includes a central swivel element positioned in coaxial alignment with the housing for providing free rotation of the hub about said central axis. The housing, being movably mounted on the base, may be moved downwardly by pressing on the shell to align the cavities with the channels thereby permitting free movement of playing pieces from the channels into the cavities and freeing up any balls jammed in the cavity. The housing includes a spring loaded plunger apparatus consisting of a piston, a coiled spring and a shaft adapted to associate with the socket in the hub to permit free swiveling, mounted in the hollow nipple and extending through the hub for cooperating with the base permitting freedom of movement of the hub relative to the housing.

Also provided is a spring loaded plunger extending inwardly from the housing and base for providing free rotation of the central hub about an axis defined perpendicular to the plane of the channels about a common axis within the five equally spaced channels containing the playing balls and a single blocker ball. This rotation motion is necessary for the transportation of balls from one channel to the next.

Finally the player balls and the blocker ball have been described as spherical in shape. The channels are in tubular arrangement. The diameter of the channels is slightly larger than those of the balls. The design could be altered such that the player balls and the blocker ball would be of a different geometry, the channels taking on a complimentary configuration. An example of which might be smaller square cubes of different colors or markings sliding in slightly larger square tracks.

The invention will be described for the purposes of illustration only in connection with certain embodiments. However, it is recognized that those persons skilled in the art may make various changes, modifications, improvements and additions on the illustrated embodiments all without departing from the spirit and scope of the invention.

BRIEF DESCRIPTION OF THE PREFERRED EMBODIMENT

Figure 1:
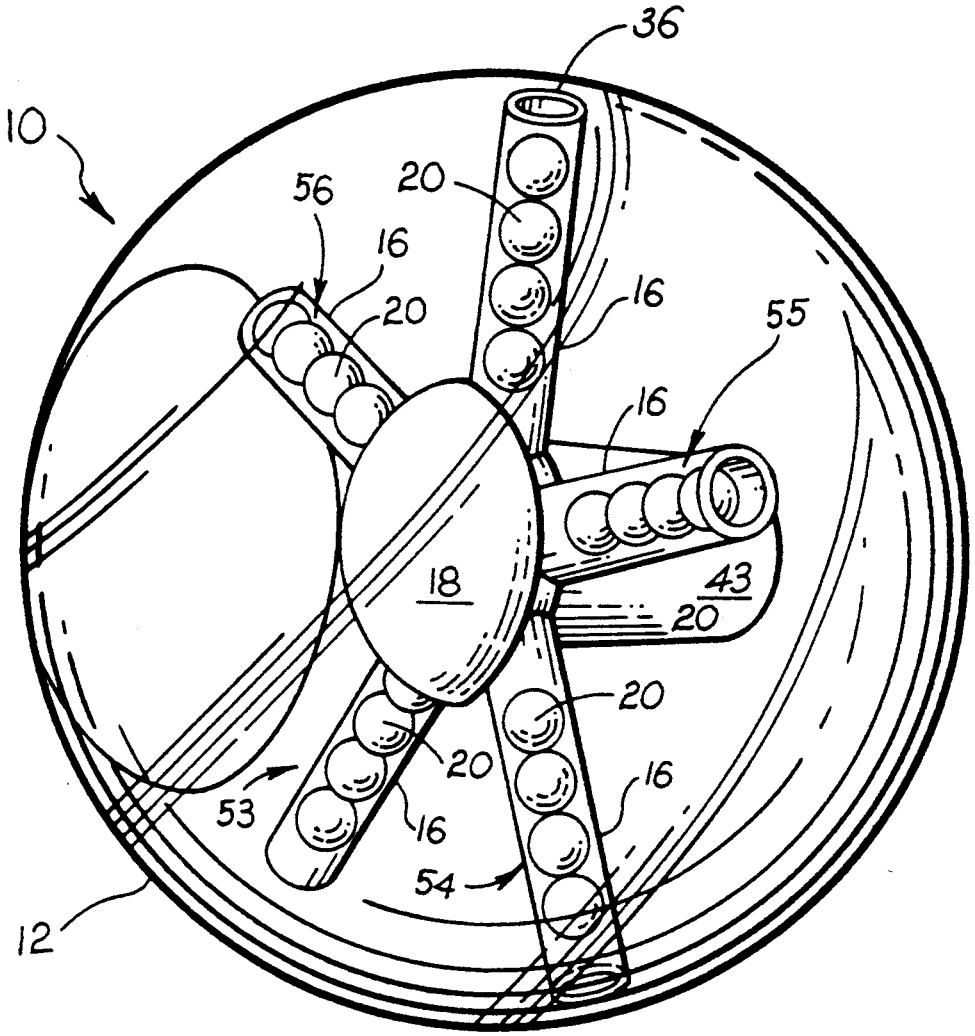
FIG. 1 is an isometric view of the present invention in a three dimensional form.
Figure 2:
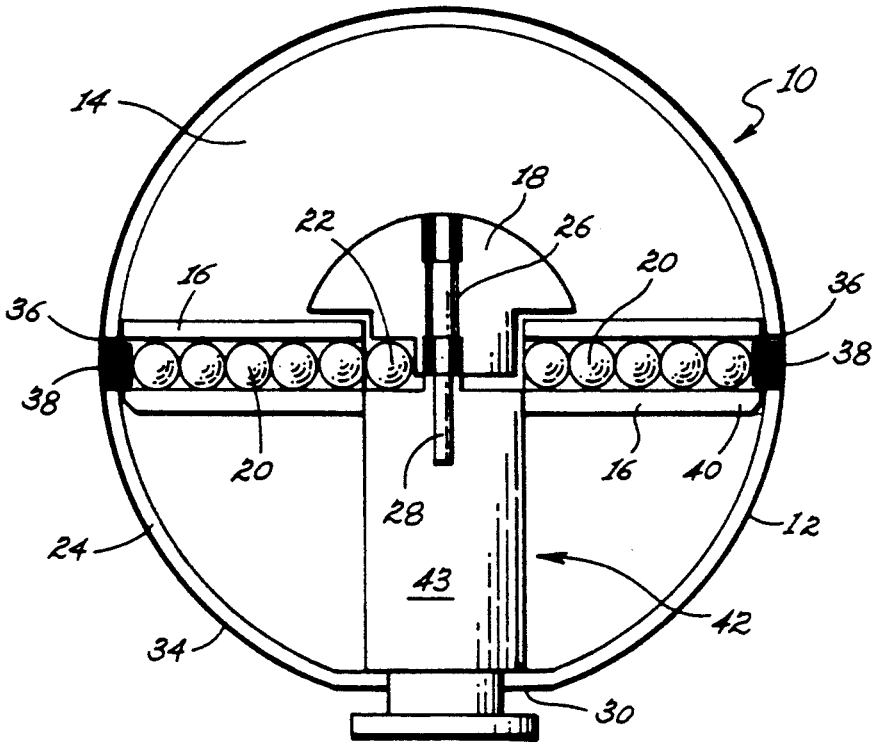
FIG. 2 is a sectional of the invention of FIG. 1 in the lower free swiveling position.
Figure 3:
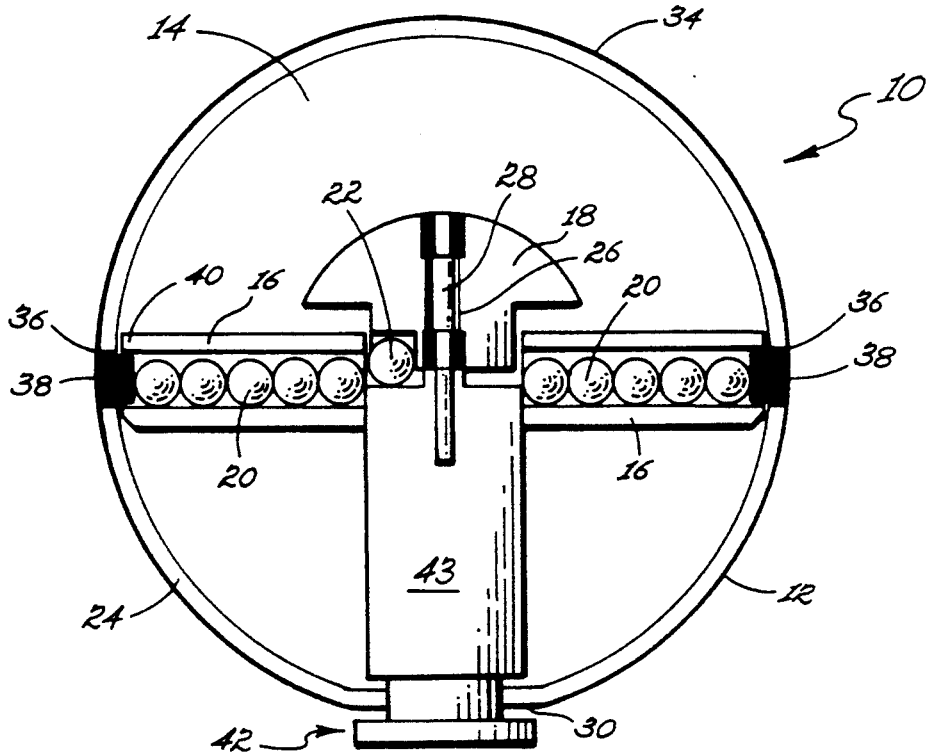
FIG. 3 is a sectional view of the invention of FIG. 1 shown in the upper locked position.

With reference to the drawings, in FIG. 1 there is shown and illustrated a game puzzle 10 of the invention which includes a housing 12 defining a main chamber 14 containing a plurality of tubular channels 16 centrally connected to a pivotably mounted central hub 18. Said channels contain five sets of game pieces 20 and a unitary blocker piece 22. As shown in FIGS. 1, 2 and 3, the housing 12 is provided with a spherical shell member 24 adapted to be hand held, and includes a flat exterior surface 30 which is coplanar with the axis of the plane of the tubular channels16. Said housing, being constructed typically of transparent material and having a vertical and horizontal axis, has an outer surface 34 and a plurality, typically five equally, spaced annular members 36 having through holes and positioned on the horizontal axis of the housing 12. Annular members 36 are equally spaced to permit entrance and exit of game pieces 20 with respect to the five tubular channels 16. Said annular members are positioned on the circumference of the housing at the inner section of the horizontal axis therewith. The annular members must have a diameter greater than the diameter of the player pieces 20. There is also provided a plurality of closure plugs 38, typically five in number, for providing closure devices for the annular members 36 for enclosing game pieces 20 within the housing 12 during the course of play.

Mounted in the main chamber 14 are a plurality of tubular channels 16, typically five in number, of transparent tubular construction, in equally spaced relation, extending radially outward from the vertical axis of the housing 12 and intersecting said housing along the horizontal axis of the housing 12 wherein the outer end 40 of the tubular channels 16 are in communication with the annular members 36. Annular members are adapted to removably receive the closure plugs 38. The closure plugs 38 may be manually removed, selectively at the option of the player, for rearranging the game pieces 20.

Figure 4:
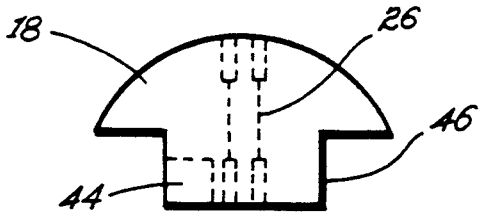
FIG. 4 is a sectional view of the hub of the invention of FIG. 1.
Figure 5:
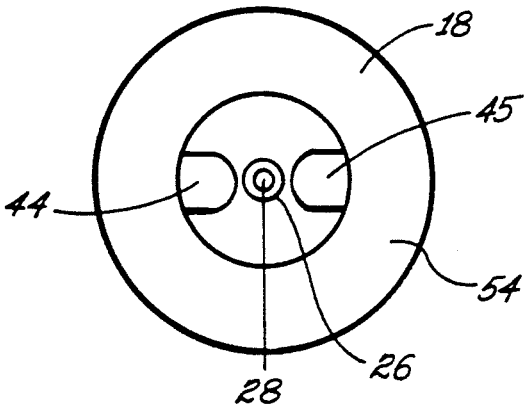
FIG. 5 is a top plan view of the invention of FIG. 4.

As shown in FIGS. 2 and 3, there is positioned at the center of the main chamber 14 a central hub 18. Said hub is typically of truncated spherical construction being pivotably mounted on a shaft 28 which is mounted in a bore 26 of a movable base 42 including a column element 43, coaxial with the central vertical axis of the central hub 18, for providing free rotation of the central hub 18 relative to the housing 12 about the vertical axis. The central hub 18 as shown in FIG. 4, is characterized by two cavities 44 and 45. Said hub is typically of spherical construction, having a circumferential recess 46 for accepting the inner ends 48 of the tubular channels 16 being positioned in coplanar relationship therewith. The two cavities 44 and 45 are constructed to accept any one of the game pieces 20 including a blocker ball 22. The central hub 18 has an opaque outer surface 50 for obscuring the players view of the inner contained game pieces 20 positioned within cavities 44 and 45. The cavities 44 and 45 are in spaced relationship, the spacing being the radial distance between the tubular channels 16. The game piece sets 20 typically consist of five sets of four pieces each. The first set, being shown as 53, is all of one color. The second set, being shown as 54, is all of one color. The third set, being shown as 55, is all of one color. The fourth set, being shown as 56, is all of one color. The fifth set, being shown as 57, is also all of one color.

Figure 6:
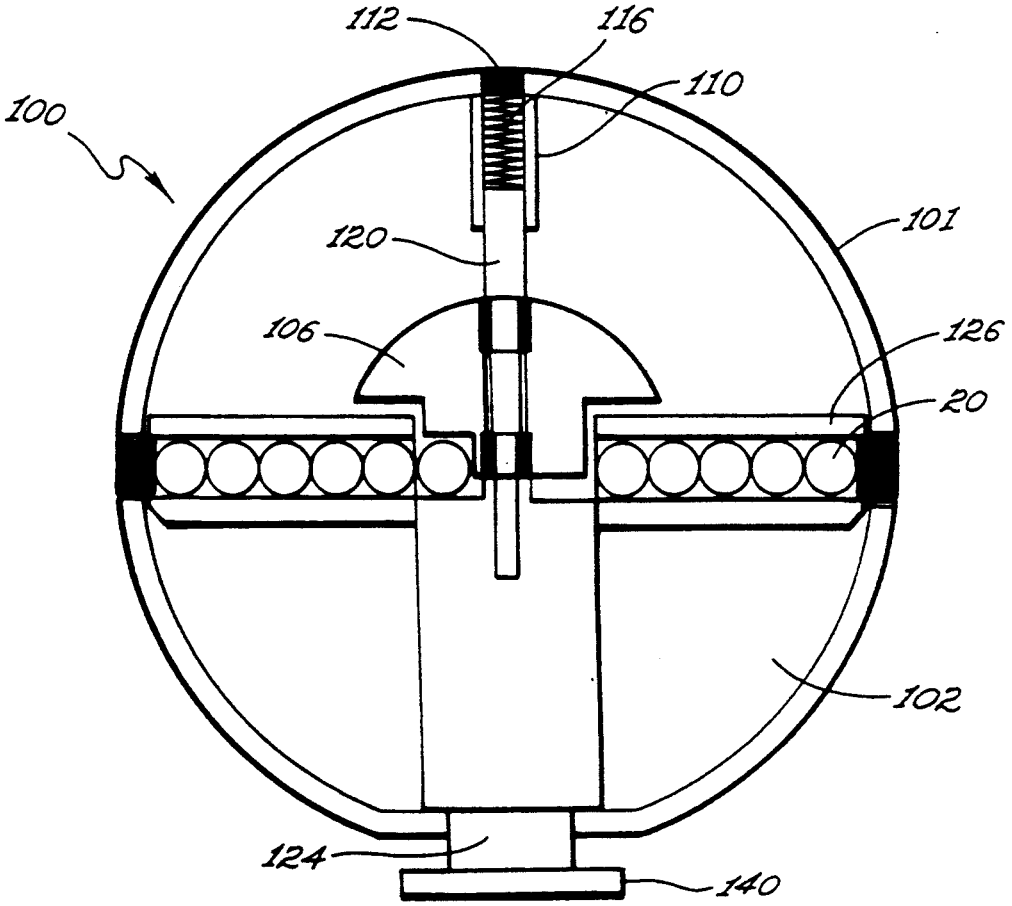
FIG. 6 is a sectional view of an alternate embodiment of the invention.
Figure 7:
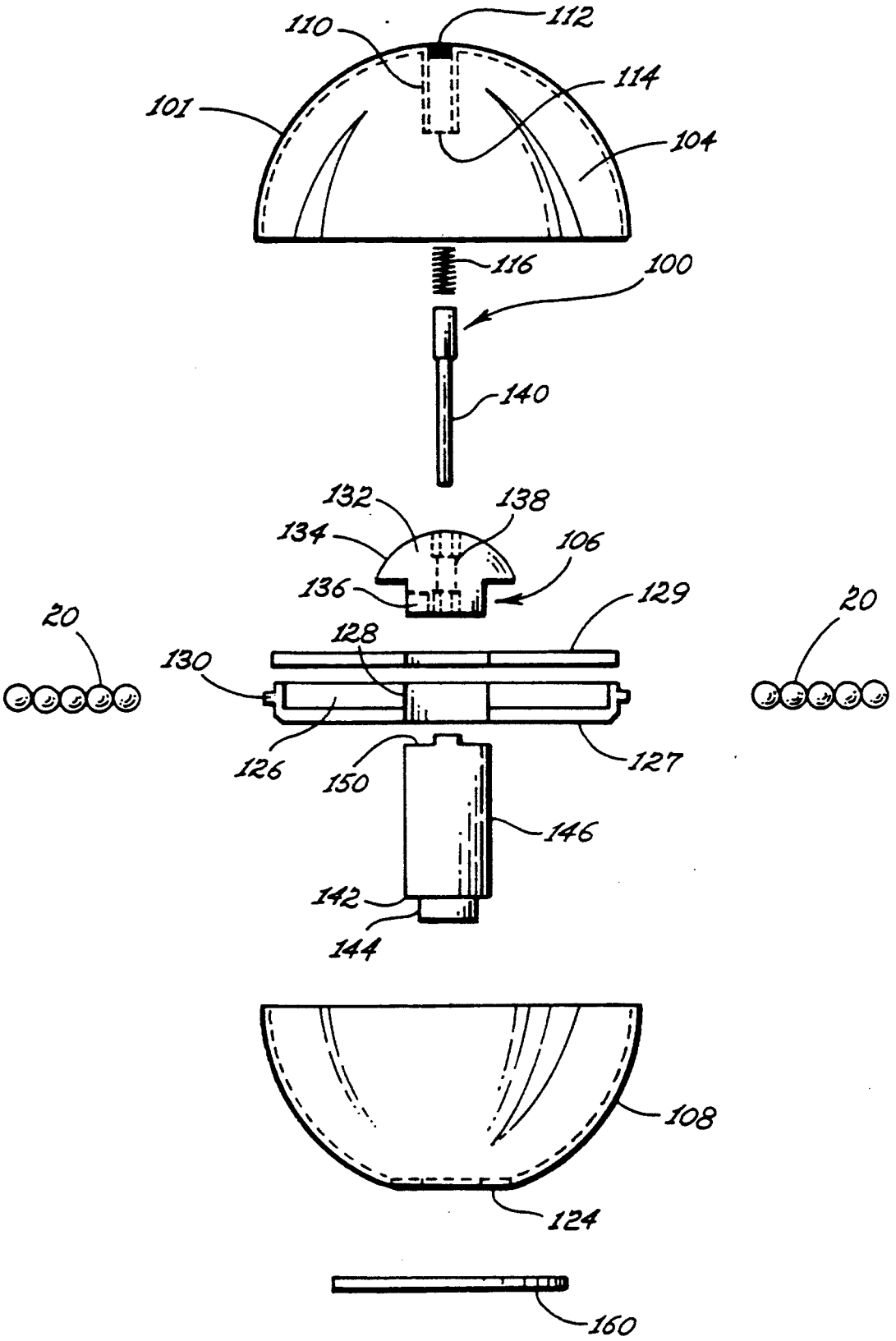
FIG. 7 is an exploded view of the hub of the invention of FIG. 6.

As is shown in FIG. 7, an alternate embodiment of the invention, a multi-channeled game puzzle with spring loaded plunger, 100 includes a housing 101 configured as a spherical shell having a central axis defining a main chamber 102. Housing 101 consists of a top half hemispherical shell member 104 and a bottom half hemispherical member 108 as shown in FIG. 6. Said top half hemispherical shell member 104 includes a hollow nipple 110 positioned coaxially on the central axis having a plugged outer end 112 and an open inner end 114 and enclosing a coiled spring 116 for receiving a plunger swivel 120. The bottom half hemispherical shell member 108 is provided with a flat bottom surface 122 characterized by an annular opening 124 located coaxially with the central axis of said tube.

A plurality of channels 126 are provided for containing one or more game pieces 20. Five hollow channels 126 are positioned in a planar dish 127, perpendicular to the central axis, equally spaced and extend radially outward from the central vertical axis. Each channel 126 includes an inner open end 128 and an enclosed outer end 130. The outer end 130 connects to the housing 101. The planar dish 127 is provided with a removable top 129.

As is seen in the FIGS., a hub 106 is centrally positioned in the main chamber 102 for selectively connecting adjacent channels 126 for transferring game pieces 20. The hub 106 comprises a dome element 132, having an opaque exterior surface 134, defining a plurality of cavities 136 and forming a movable passageway for game pieces 20. The dome element includes a central socket 138 that is positioned in coaxial alignment with the housing 101 for providing free rotation of the hub 106 about said central axis.

Referring to FIG. 7, there is shown a shaft 140 for rotably mounting the hub 106 within the main chamber 102 for rotation about a common vertical axis, and for permitting free swiveling in both directions upon manual tilting of said housing 101. The housing 101 is mounted on a base having a collar 142 and a circular recess 144. Said base also includes a cylindrical column 146 having a defined circumference extending along the central axis from said base to the middle of the main chamber 102 having a top surface 150 adjacent the base of hub lee which includes a dome element 132 having an opaque surface 134 and a central socket 138.

What is claimed is:

1. A game puzzle comprising in combination:

a) a housing having a shell adapted for manual tilting with a transparent surface and defining a main chamber having a vertical axis and a horizontal axis;

b) a plurality of channels positioned in a common plane within the main chamber, and extending radially outward from the vertical axis of the main chamber, each channel having an inner end and an outer end, the outer end being attached to the shell;

c) movable base means for supporting the housing comprising a column element having a central bore, a flat base member for supporting the game puzzle on a flat surface, a groove member with shoulder configured to associate with a bottom aperture of the housing for permitting reciprocal movement along the vertical axis of the housing relative to the base member, the column element extends from the base member base of the housing upwardly to the midpoint of the housing for supporting a hub means;

d) hub means for selectively connecting adjacent channels for transferring game pieces comprising a dome shaped hub mounted on a central shaft disposed within the bore of the column element for permitting free rotation about the vertical axis defining a plurality of cavities forming a movable passageway, said hub means, being mounted on the column, is adapted for reciprocal movement relative to the inner ends of the channels for movement between a lower free swiveling position and an upper locking position and is responsive to manual pressure exerted on the base means;

e) pivot means comprising a central shaft configured for rotably mounting the hub means within the main chamber for rotation about a vertical axis, common with the vertical axis of the housing for permitting free swiveling in both directions upon manual tilting of the housing of said hub means, when in the lower free swiveling position;

f) a plurality of sets of game pieces, each set being visually different;

g) annular means positioned on the shell at the outer ends of the channels for accessing game pieces;

h) closure plug means for providing removable closure for the annular means; and i) a unitary blocker piece, having distinctive marking characteristics, wherein the shell of the housing is manually grasped by a player for play, by titling, to move selectively the game pieces from one channel to another via the hub means by releasing the base means to permit the hub means to move from the upper locking position to the lower swivel position by force of gravity, thence by manually rotating the hub means mounted on the column relative to the inner ends of the channels, thereby permitting the hub means to accept and discharge player pieces for rearrangement.

2. The game puzzle of claim 1 wherein each game piece has sufficient weight to move in the channels as the housing is tilted.

3. The game puzzle of claim 1 wherein the channels range from 2–6.

4. The game puzzle of claim 1 wherein the hub means comprises a truncated sphere.

5. The game puzzle of claim 1 wherein the hub means pivots around the central axis mounted on bearing means mounted on the shaft.

6. The game puzzle of claim 1 wherein the channels are equally spaced apart from each other extending radially outward.

7. The game puzzle of claim 1 wherein each set of the game pieces are separately identified being visually different.

8. The game puzzle of claim 1 wherein each set of the game pieces has different coloration.

9. The game puzzle of claim 1 wherein the hub means is non-transparent and includes obscuring means for obscuring from view game pieces contained therein.

10. The game puzzle of claim 1 wherein the plurality of sets of game pieces comprise:

a) a first set of at least two pieces each of said pieces characterized by a first color;

b) a second set of game pieces having at least two pieces each of said pieces characterized by a second color;

c) providing a third set of game pieces having at least two pieces each of said pieces characterized by a third color;

d) a fourth set of pieces having at least two pieces each of said pieces characterized by a fourth color; and e) a fifth set of game pieces having at least two pieces each of said pieces characterized by a fifth color.

11. The game puzzle of claim 1 wherein the housing is constructed of transparent material comprising a flat bottom mounting surface coplanar with the plane of the channels, and having a central aperture for receiving the column of the base.

12. The game puzzle of claim 1 wherein the pivot means comprises a shaft mounted on the column having at least one bearing element.

13. A game puzzle comprising in combination:

a) a housing constructed of transparent material comprising at least one flat surface, a shell adapted for manual tilting, a main chamber having a vertical axis and an horizontal axis and the shell being of spherical construction;

b) a plurality of channels of tubular construction wherein each channel is constructed to accept up to five game pieces at any one time and said channels positioned in a common plane within the main chamber each being equally spaced and extending radially outward from the vertical axis of the main chamber each channel having an inner end and an outer end, the outer end being attached to the shell;

c) a central hub having an opaque exterior surface defining a hollow interior for providing a connecting passageway characterized by two interconnected chambers adjacently positioned and adapted to receive any of the playing pieces including the blocker piece, positioned in coplanar relationship to a pair of adjacent channels accessed by the central hub;

d) swivel means for rotably mounting the central hub within the main chamber for permitting free swiveling in both directions upon manual tilting of the housing, comprising a spring loaded plunger comprising;

i) a piston contained in the hollow nipple;

ii) a shaft attached to the piston configured to extend through the central hub in association with the pivot means and to abut the cylindrical base;

iii) spring means contained in the nipple associated with the piston normally acting to urge the housing in a raised swivel position and alternately to compress responsive to downward pressure exerted against the housing for releasing playing pieces caught between the hub means and the channel means mounted on the inner surface of the shell on the common vertical axis of the shell and the central hub for rotably mounting the central hub within the main chamber for rotation about a vertical axis common with the vertical axis of the housing for permitting free swiveling in both directions upon manual tilting of the housing;

e) socket means in the central hub for cooperating with the swivel means permitting freedom of movement of the central hub relative to the housing;

f) a plurality of sets of game pieces each set being identified by a distinct color wherein the plurality of sets of game pieces comprise;

i) a first set of at least two pieces each of said characterized by a first color;

ii) a second set of game pieces having at least two pieces each of said pieces characterized by a second color;

iii) providing a third set of game pieces having at least two pieces each of said pieces characterized by a third color;

iv) a fourth set of game pieces having at least two pieces each of said pieces characterized by a fourth color;

v) a fifth set of game pieces having at least two pieces each of said pieces characterized by a fifth color;

vi) an annular means positioned on the shell at the end of the channels for accessing game pieces and for providing access for selectively resetting the game pieces for scrambling the sequence of said game pieces;

vii) a unitary blocker piece having distinctive marking characteristics wherein the shell of the housing is manually grasped by a player for play by tilting to selectively move game pieces from one channel to another via the central hub by rotating the central hub mounted on the swivel means relative to the housing and for the central hub to accept and discharge player pieces for rearrangement.

14. The game puzzle of claim 13 wherein the housing comprises;

a) a top half hemispherical member including a hollow nipple centrally positioned on the central axis of the housing; and b) a bottom half hemispherical member having a flat bottom surface characterized by an annular opening located coaxial with the central axis and said nipple; and whereby the housing is manually grasped by a player for play by tilting to selectively move game pieces from one channel to another via the hub means by causing the hub means to swivel on the pivot means relative to the housing, for the central hub to accept and discharge player pieces for rearrangement and the base means is adapted for move vertically to permit freedom of movement of the player pieces when formed in an inner chamber.

* * * * *